US009923286B2

(12) United States Patent
Cheng et al.

(10) Patent No.: US 9,923,286 B2
(45) Date of Patent: Mar. 20, 2018

(54) ELECTRICAL CONNECTOR AND METHOD MAKING THE SAME

(71) Applicant: FOXCONN INTERCONNECT TECHNOLOGY LIMITED, Grand Cayman (KY)

(72) Inventors: Chih-Pi Cheng, New Taipei (TW); Wen He, Shenzhen (CN); Quan Wang, Shenzhen (CN); Ke-Hao Chen, New Taipei (TW); Xiao-Qin Zheng, Kunshan (CN); Ke-Hua Wu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/636,612

(22) Filed: Jun. 28, 2017

(65) Prior Publication Data

US 2017/0373408 A1 Dec. 28, 2017

(30) Foreign Application Priority Data

Jun. 28, 2016 (CN) ..... 2016 1 0479259

(51) Int. Cl.

| | |
|---|---|
| ***H01R 13/502*** | (2006.01) |
| ***H01R 9/03*** | (2006.01) |
| ***H01R 13/62*** | (2006.01) |
| *H01R 43/00* | (2006.01) |

(52) U.S. Cl.

CPC ..... *H01R 9/032* (2013.01); *H01R 13/62* (2013.01); *H01R 43/00* (2013.01)

(58) Field of Classification Search

CPC .... H01R 9/032; H01R 13/6581; H01R 13/62; H01R 13/659; H01R 13/6461; H01R 13/6485; H01R 13/6565; H01R 13/6585; H01R 24/60; H01R 43/00

USPC ..... 439/701

See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 8,968,031 | B2 * | 3/2015 | Simmel | H01R 13/659 439/108 |
| 9,472,910 | B2 | 10/2016 | Fit | |
| 9,496,654 | B2 | 11/2016 | Fit | |
| 9,608,391 | B2 * | 3/2017 | Little | H01R 24/60 |

(Continued)

*Primary Examiner* — Jean F Duverne

(74) *Attorney, Agent, or Firm* — Wei Te Chung; Ming Chieh Chang

(57) ABSTRACT

An electrical connector includes an insulative housing having a tongue portion with opposite upper and lower surfaces, a plurality of upper terminals and a plurality of lower terminals with contacting sections exposed upon the corresponding upper surface and lower surface, respectively. A metallic shielding plate located between upper terminals and the lower terminals. The tongue portion forms a first type hole in which the upper power terminal mechanically and electrically connects to the lower power terminal, and a second type hole in which either the upper grounding terminal mechanically and electrically connects to an upper face of the shielding plate or the lower grounding terminal mechanically and electrically connects to the lower face of the shielding plate.

6 Claims, 11 Drawing Sheets

(56) References Cited

U.S. PATENT DOCUMENTS

| | | | | |
|---|---|---|---|---|
| 2010/0267261 | A1* | 10/2010 | Lin | H01R 13/6461<br>439/218 |
| 2014/0024257 | A1* | 1/2014 | Castillo | H01R 13/6585<br>439/607.05 |
| 2015/0295362 | A1* | 10/2015 | Tziviskos | H01R 13/6581<br>439/607.01 |

* cited by examiner

ELECTRICAL CONNECTOR AND METHOD MAKING THE SAME

BACKGROUND OF THE DISCLOSURE

1. Field of the Disclosure

The present disclosure relates to an electrical connector, and particularly to an electrical connector made via an insert-molding process.

2. Description of Related Arts

USB committee issued a new type electrical connector assembly on Aug. 11, 2014 to allow the plug connector to be inserted into the corresponding receptacle connector in a flippable manner for transmitting both the USB 2.0 and USB 3.1 signals. This new type electrical connector is called USB Type C connector. Because such an electrical connector is relatively small while having more than twenty contacts thereof, the manufacturing method is believed to be a tough issue for the makers.

A new method for making such an electrical connector is desired.

SUMMARY OF THE DISCLOSURE

Accordingly, an object of the present disclosure is to provide an electrical connector with the superior electrical and mechanical connection characteristics and easy making characteristics.

To achieve the above object, an electrical connector includes an insulative housing having a tongue portion with opposite upper and lower surfaces, a plurality of upper terminals and a plurality of lower terminals with contacting sections exposed upon the corresponding upper surface and lower surface, respectively. A metallic shielding plate located between upper terminals and the lower terminals. The upper terminals include the power terminals and the grounding terminals, and the lower terminals include the power terminals and the grounding terminals. The tongue portion forms a first type hole in which the upper power terminal mechanically and electrically connects to the lower power terminal, and a second type hole in which either the upper grounding terminal mechanically and electrically connects to an upper face of the shielding plate or the lower grounding terminal mechanically and electrically connects to the lower face of the shielding plate.

The manufacturing method of making the electrical connector includes the following steps. The lower terminals and the shielding plate are commonly integrally formed within a first insulator to form a sub-assembly via a first stage insert-molding process wherein the upper surface of the first insulator forms a plurality of grooves. The upper terminals are disposed in the grooves and a second insulator is applied upon both the upper terminals and the sub-assembly via a second stage insert-molding process to form the full contact module wherein during the second stage insert-molding process the corresponding mold dies presses front end regions of the corresponding power terminals and grounding terminals so as to leave the corresponding first type holes and second type holes in the contact module after the second stage insert-molding process. Understandably, the mold dies are used to reinforce the pressure between the upper power terminal and the lower power terminal, or that between the upper grounding terminal and the shielding plate or between the lower grounding terminal and the shielding plate during the second stage insert-molding process. Notably, such first type holes and second type holes may be alternately filled by another insulator in place of the vacant space therein for preventing improper foreign particle invasion.

DETAILED DESCRIPTION OF THE PREFERRED EMBODIMENT

Figure 1:
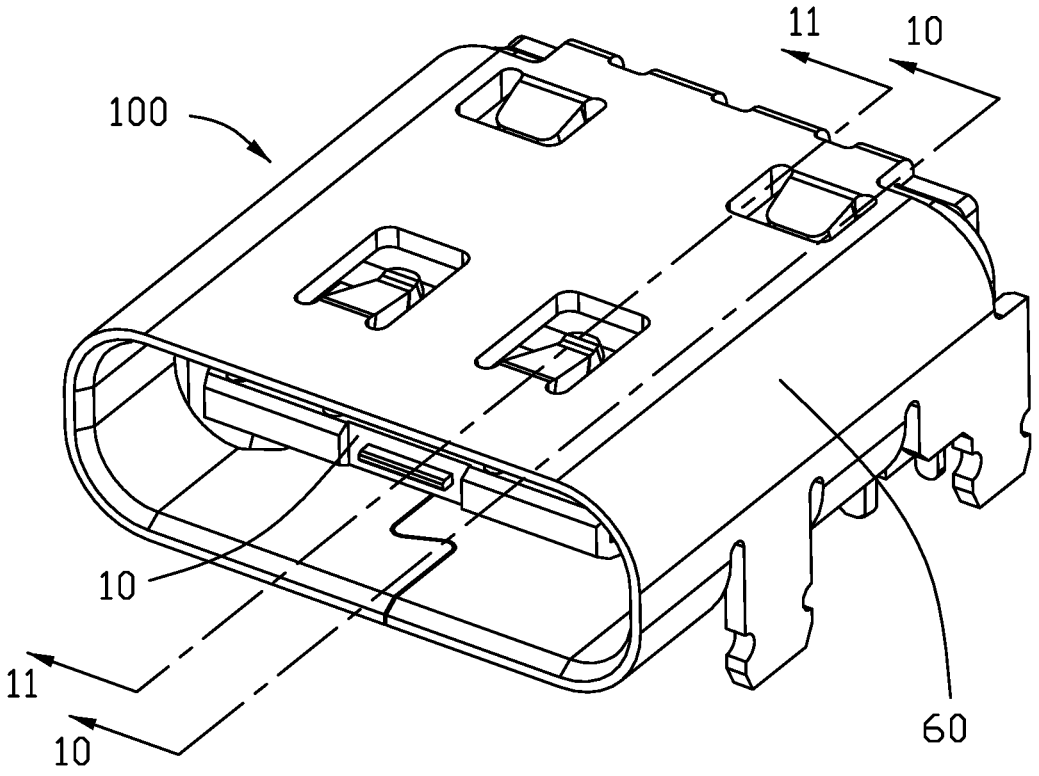
FIG. 1 is a perspective view of an electrical connector of the invention.
Figure 2:
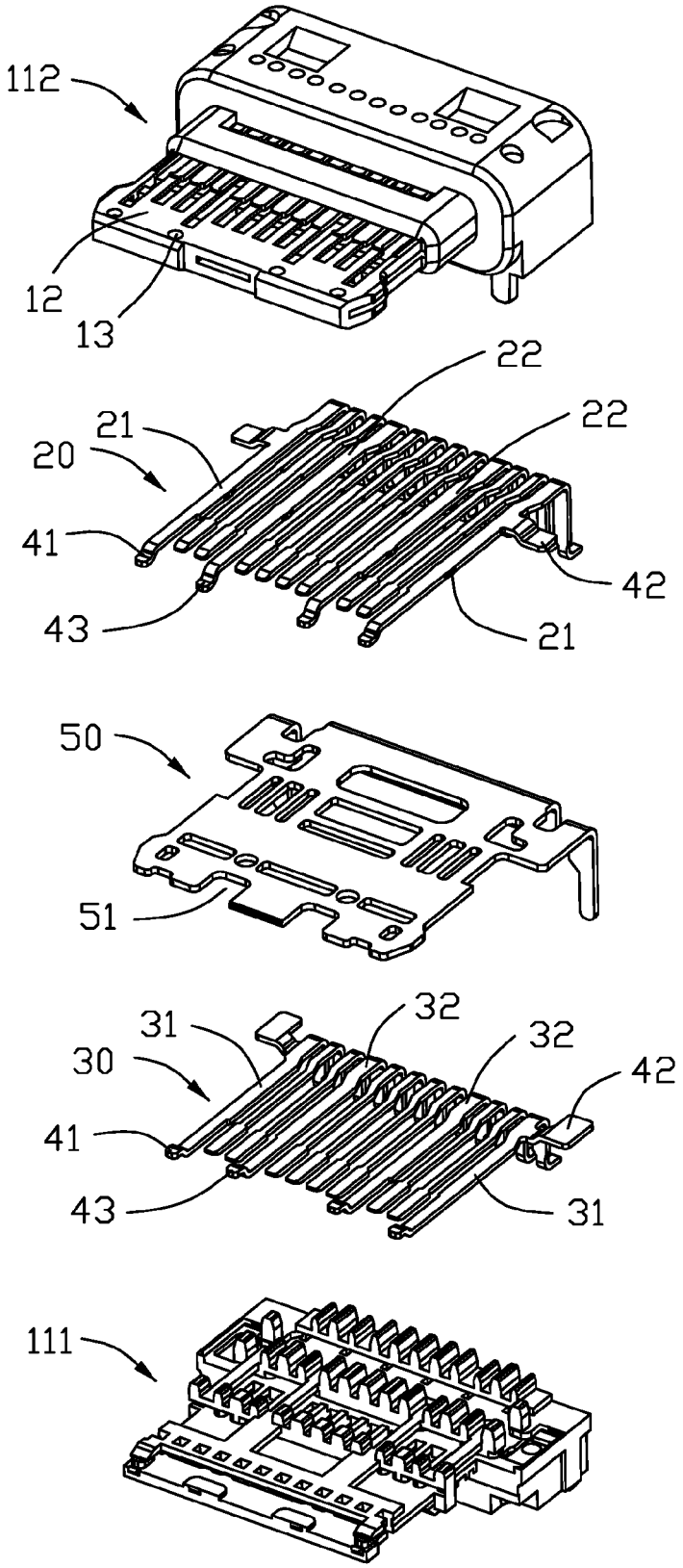
FIG. 2 is an exploded perspective view of the contact module of the electrical connector of FIG. 1.
Figure 3:
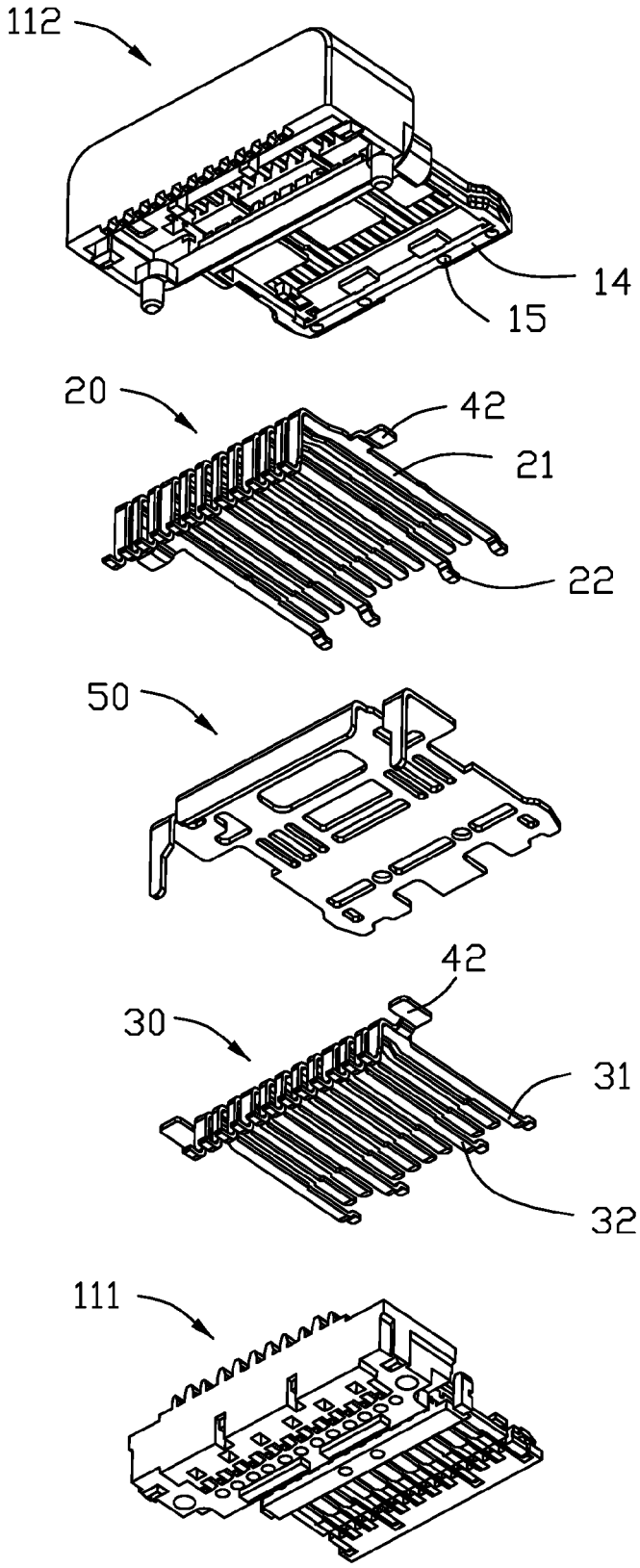
FIG. 3 is another exploded perspective view of the contact module of the electrical connector of FIG. 1.
Figure 4:
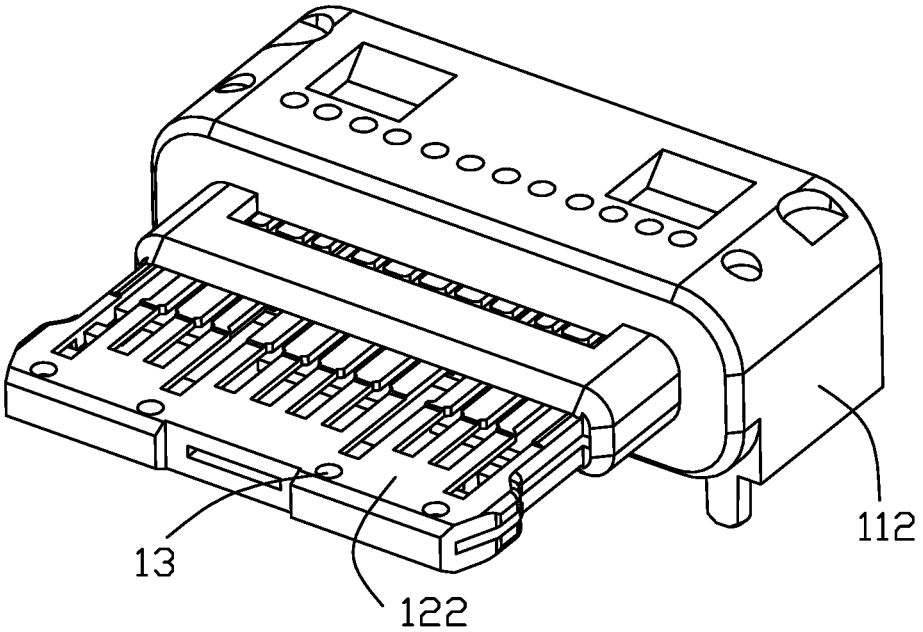
FIG. 4 is an exploded perspective view of the contact module of the electrical connector of FIG. 1 wherein the sub-assembly is formed after the first stage insert-molding process.
Figure 4:
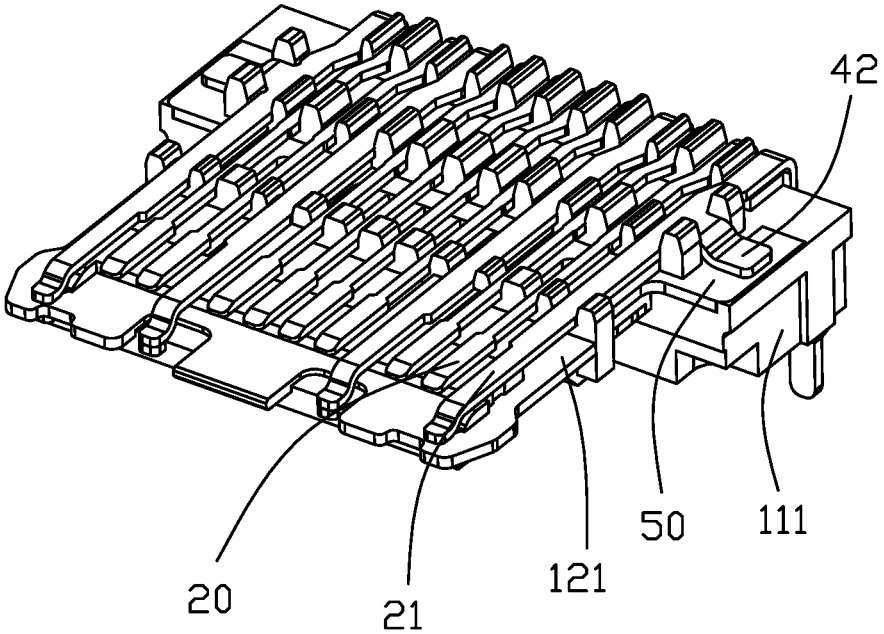
Figure 5:
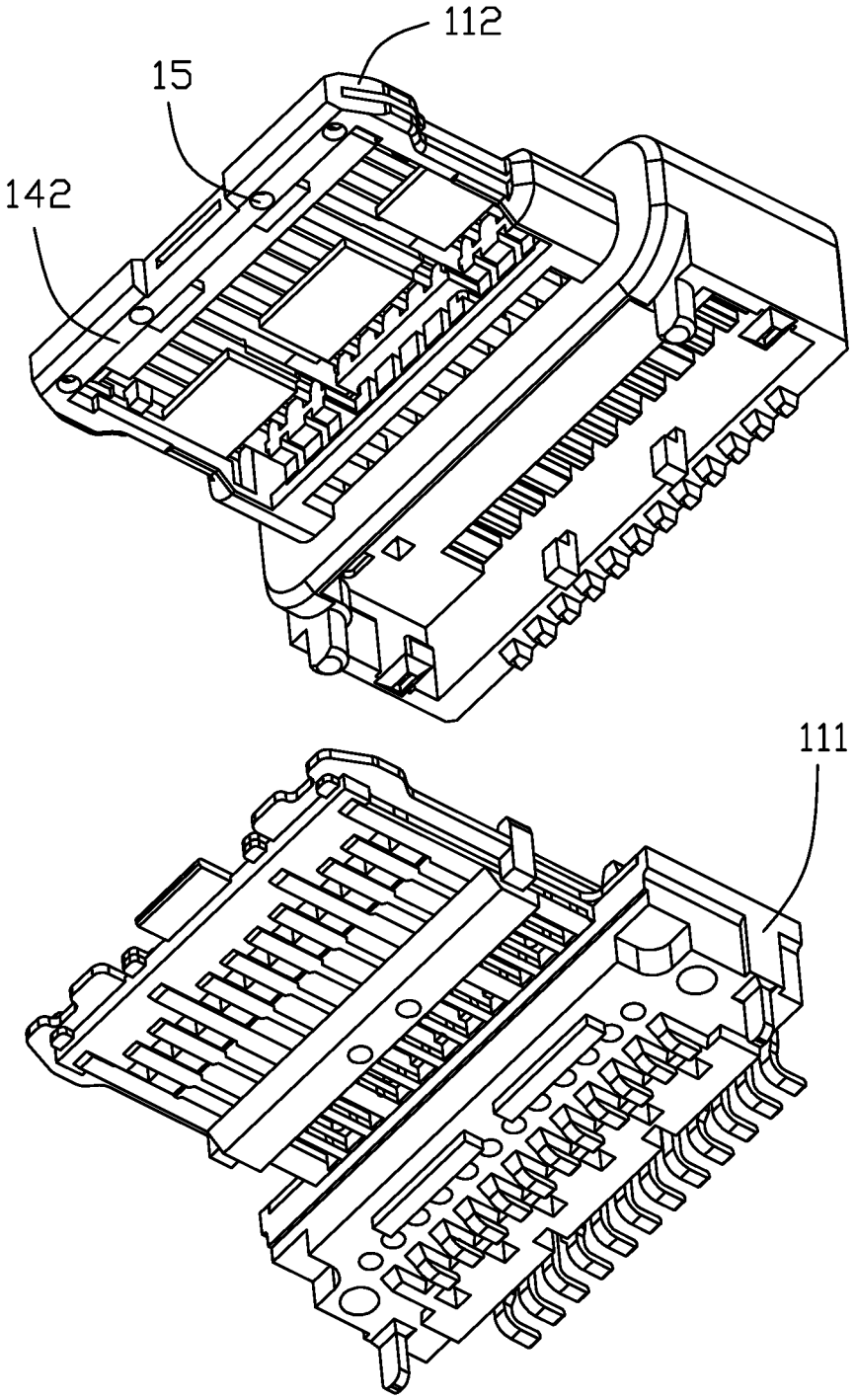
FIG. 5 is another perspective view of the contact module of the electrical connector of FIG. 4.
Figure 6:
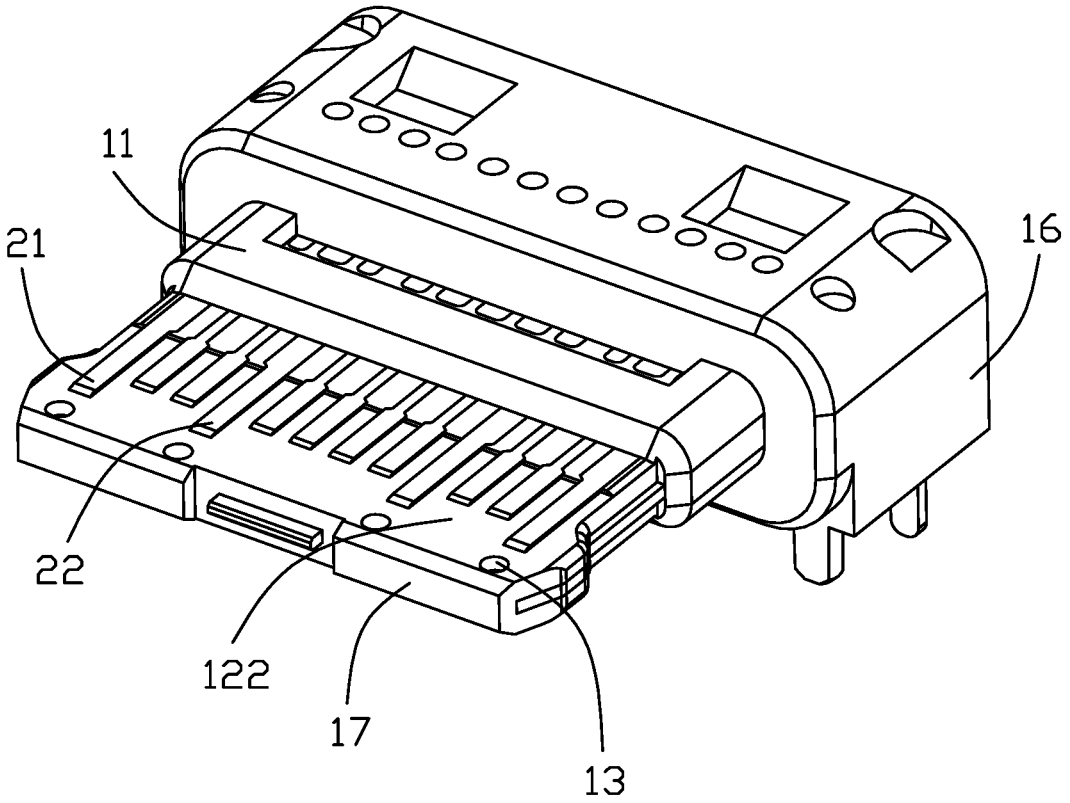
FIG. 6 is a perspective view of the contact module of the electrical connector of FIG. 3.
Figure 7:
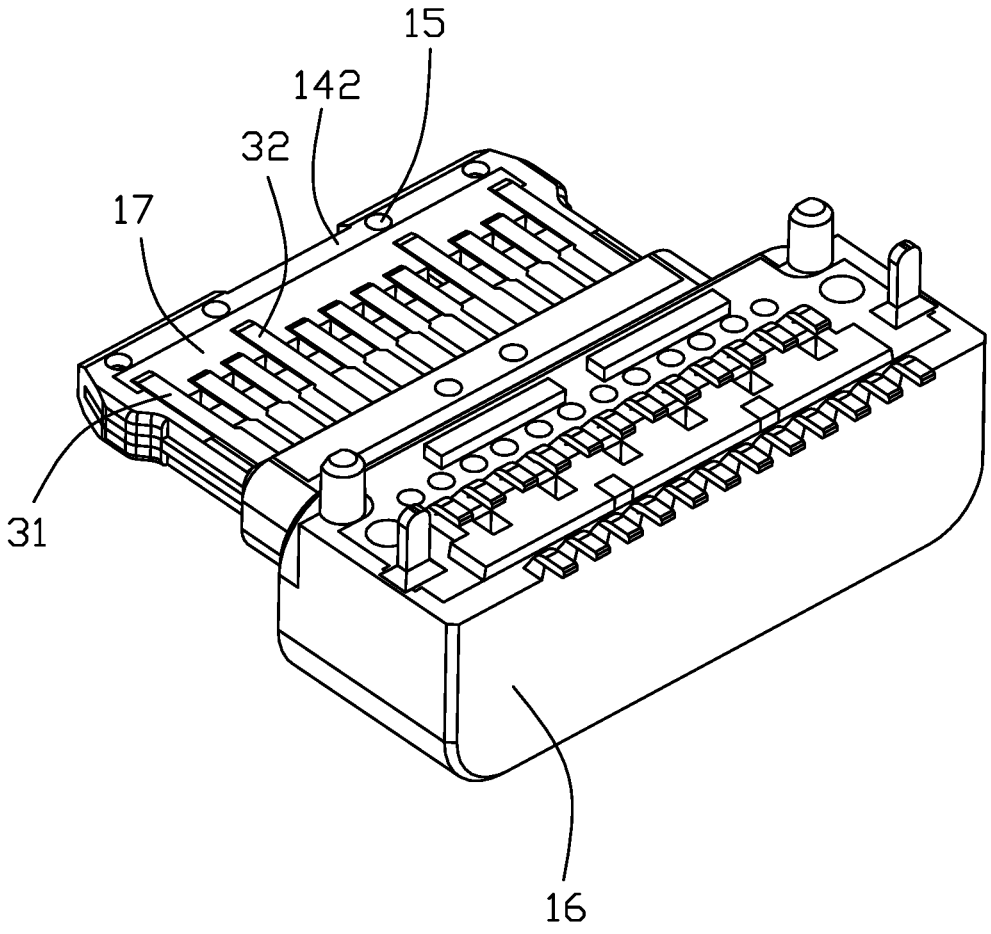
FIG. 7 is another perspective view of the contact module of the electrical connector of FIG. 6.
Figure 8:
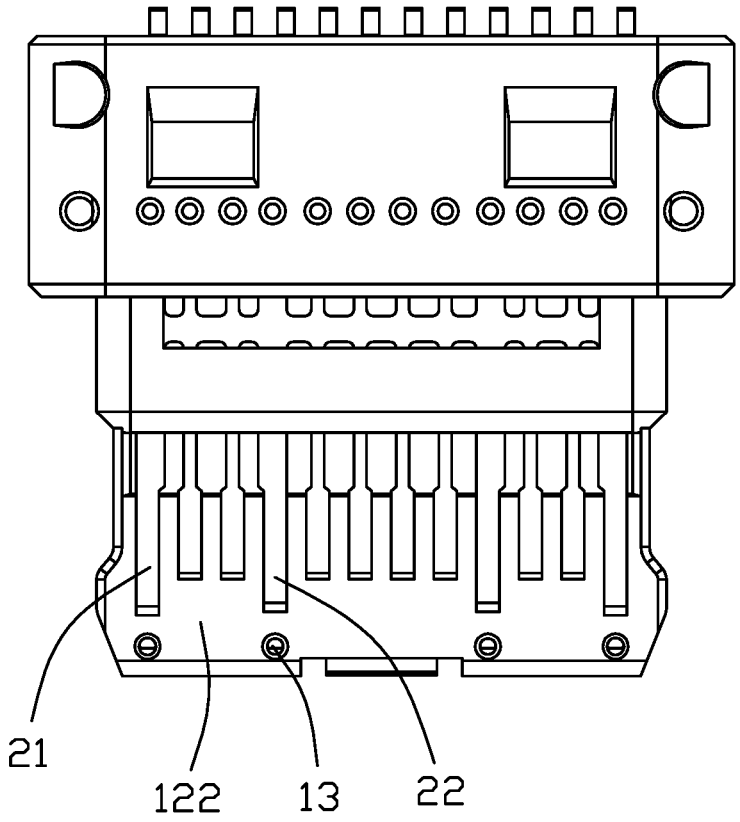
FIG. 8 is a top view of the contact module of the electrical connector of FIG. 6.
Figure 9:
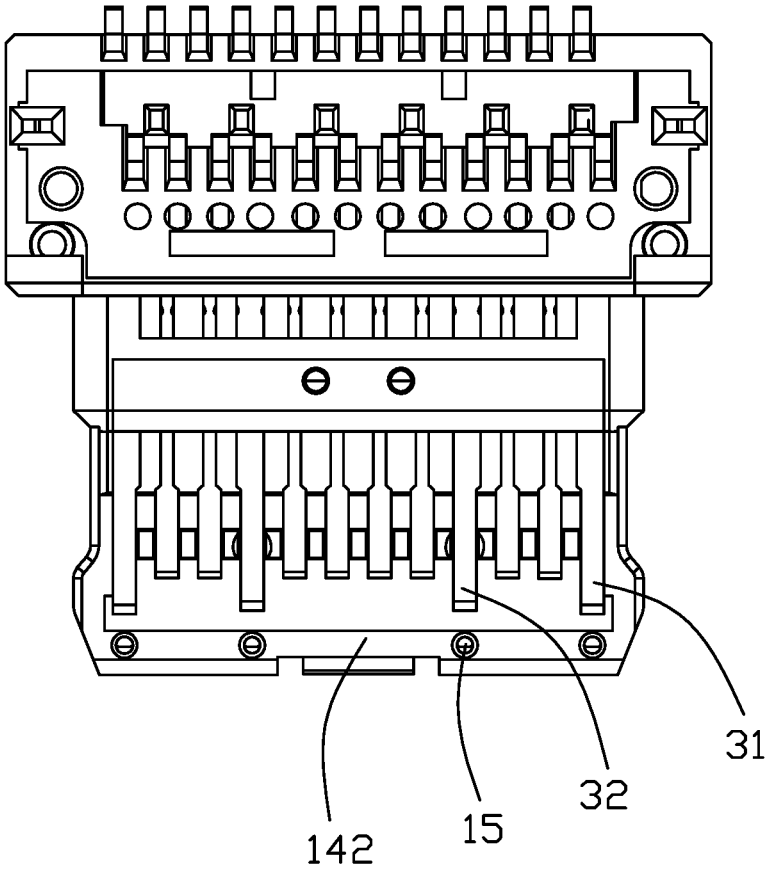
FIG. 9 is a bottom view of the contact module of the electrical connector of FIG. 6.
Figure 10:
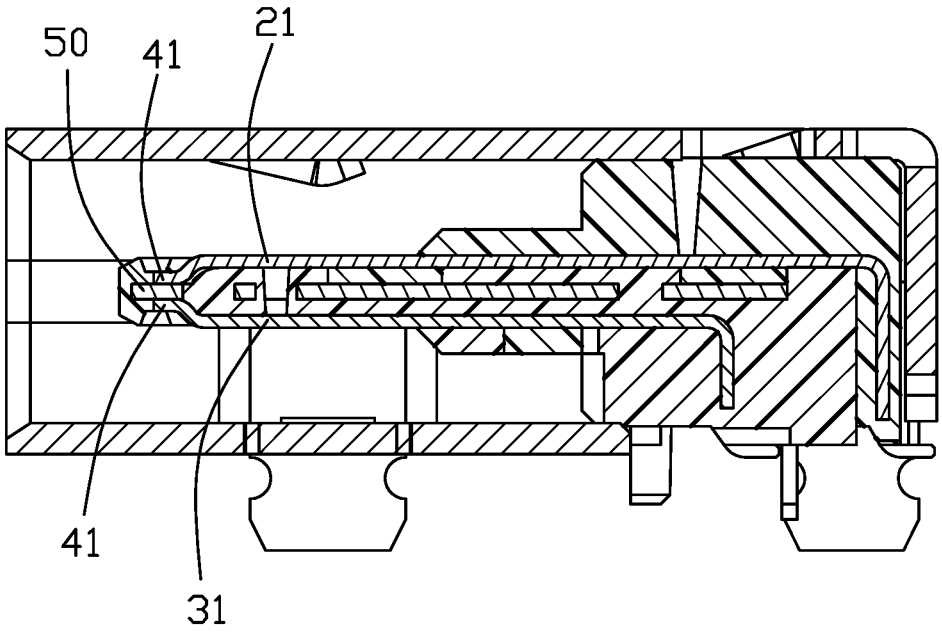
FIG. 10 is a cross-sectional view of the electrical connector of FIG. 1.
Figure 11:
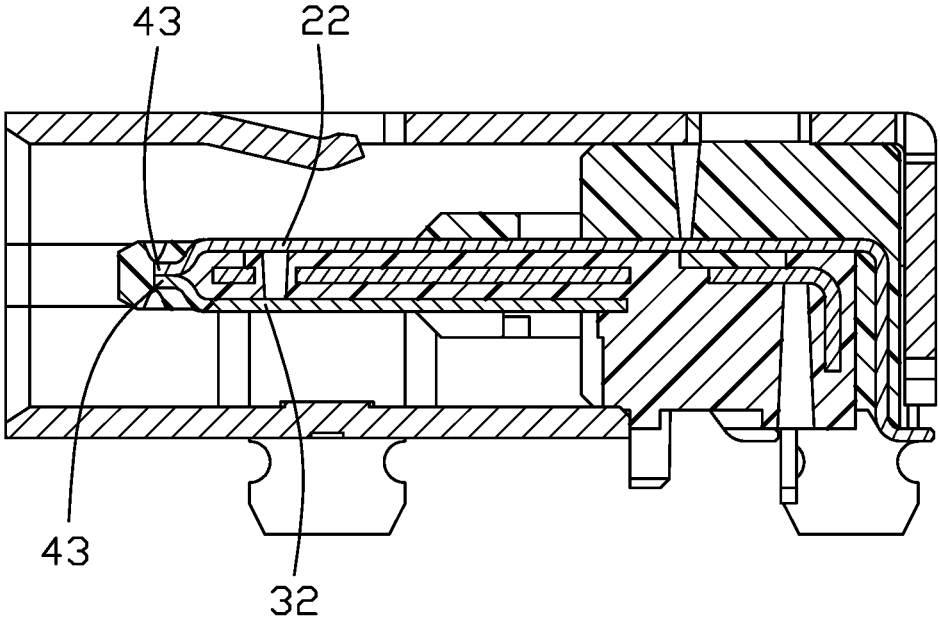
FIG. 11 is another cross-sectional view of the electrical connector of FIG. 1.

Reference will now be made in detail to the embodiments of the present disclosure. Referring to FIGS. 1-11, an electrical connector 100 includes a contact module 10 and the metallic shell 60. The contact module 10 includes an insulative housing 11 and the upper terminals 20, the lower terminals 30 and the metallic shielding plate 50 commonly embedded within the housing 11 via the insert-molding process. The shielding plate 50 is located between the upper terminals 20 and the lower terminals 30. The upper terminals 20 include the upper grounding terminals 21 and the upper power terminals 22. The lower terminals 30 include the lower grounding terminals 30 include the lower grounding terminals 31 and the lower power terminals 32. The upper grounding terminal 21 includes a rear abutting section 42, and the lower grounding terminal 31 includes a rear abutting section 41 as well. Both the rear abutting sections 42 abut against the opposite surfaces of the shielding plate 50. The housing 11 includes a base 16 and the tongue portion 17 extending forwardly from the base 16. The tongue portion 17 includes an upper surface 12 and a lower surface 14 opposite to each other in the vertical direction. The upper terminals 20 and the lower terminals 30 include corresponding contacts exposed upon the corresponding upper surface 12 and lower surface 14. The upper surface 12 forms a plurality of first/upper holes 13, the lower surface 14 forms a plurality of second/lower holes 15. The upper grounding terminals 21 are located on two lateral sides of the upper terminals 20, and the lower grounding terminals 31 are located on two lateral sides of the lower terminals 30. The upper grounding terminals 21 and the lower grounding terminals 31 are equipped with front abutting sections 41, and the upper power terminals 22 and the upper power terminals are equipped with front abutment sections 43. The front abutting section 41 of the upper grounding terminal 21 and the front abutment section 43 of the upper power terminal 22 are exposed in the corresponding first holes 13. The front abutting section 41 of the lower grounding terminal 31 and the front abutment section 43 of the lower power terminal 32 are exposed in the corresponding second holes 15. The front abutting section 41 abuts against the shielding plate 50. The shielding plate 50 forms corresponding cutouts 51 so as to have the abutment sections 43 of the upper power terminal 22 and that of the lower power terminal 32 abut against each other therein.

A manufacturing method of making the electrical connector includes the following steps: providing a plurality of lower terminals 30 and a metallic shielding plate 50 commonly embedded within a first insulator 111 to form a sub-assembly via a first stage insert-molding process wherein the upper surface 121 of the first insulator 111 forms a plurality of grooves; disposing the upper terminals 20 into the corresponding grooves and applying the second insulator 112 upon the sub-assembly to form the complete contact module 10 via a second stage insert-molding process wherein the upper surface 122 of the second insulator 112 forms a plurality of first/upper holes 13, and the lower surface 142 of the second insulator 112 forms a plurality of second/lower holes 14, and the front abutting section 41 of the upper grounding terminal 21 and the front abutment section 43 of the upper power terminal 22 are exposed in the corresponding first holes 13 and the front abutting section 41 of the lower grounding terminal 31 and the front abutment section 43 of the lower power terminal 32 are exposed in the corresponding second holes 15. The contacting sections of the upper terminals 20 and those of the lower terminals 30 are exposed upon the upper surface 122 and the lower surface 142 respectively. The contact module 10 is assembled into the shell 50.

Notably, during forming the second insulator 112, a first set of mold dies press the front abutting sections 41 of both the upper grounding terminals 21 and the lower grounding terminals 31 against the shielding plate 50, and a second set of mold dies press the front abutment sections 43 of the upper power terminal 22 against the front abutment section 43 of the lower power terminal 32 for assuring firm abutment therebetween after the complete contact module 10 is formed. Understandably, the rear abutment section 42 of the upper grounding terminal 21 and that of the lower grounding terminal 31 are arranged in a similar way with the corresponding upper and lower holes. Notably, those holes may be successively filled with the third insulator for preventing foreign particle invasion.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a metallic shielding shell;

a contact module disposed in the metallic shielding shell and including:

an insulative housing including a base and a tongue portion extending forwardly form the base in a front-to-back direction, said tongue portion forming opposite upper surface and lower surface in a vertical direction perpendicular to the front-to-back direction;

a metallic shielding plate disposed in the tongue portion between the upper surface and the lower surface;

a plurality upper terminals disposed in the housing with corresponding contacting sections exposed upon the upper surface, said upper terminals including upper grounding terminals and upper power terminals, each of said upper grounding terminals including a front abutting section and each of said upper power terminals including a front abutment section;

a plurality of lower terminals dispose in the housing with corresponding contacting sections exposed upon the lower surface, said lower terminals including lower grounding terminals and lower power terminals, each of said lower grounding terminals including a front abutting section and each of said lower power terminals including a front abutment section; wherein the front abutting sections abut against the shielding plate while the front abutment sections abut against each other; wherein the upper surface forms a plurality of upper holes to expose said front abutting sections and said abutment sections, and the lower surface forms a plurality of lower holes to expose said front abutting sections and said abutment sections.

2. The electrical connector as claimed in claim 1, wherein the lower terminals and the shielding plate are commonly integrally formed within a first insulator to form a sub-assembly, and the upper terminals are assembled upon an upper surface of the sub-assembly and a second insulator is applied upon the sub-assembly to form the complete contact module, and the first insulator and the second insulator commonly form said housing.

3. The electrical connector as claimed in claim 2, wherein said sub-assembly forms a plurality of grooves to receive the corresponding upper terminals.

4. The electrical connector as claimed in claim 1, wherein the upper grounding terminals include laterally extending rear abutting sections and the lower grounding terminals include laterally extending rear abutting sections commonly abutting against opposite surfaces of the shielding plate with corresponding upper holes and lower holes for exposure.

5. A method of making an electrical connector comprising steps of:

providing a plurality of lower terminals and a metallic shielding plate to be commonly integrally formed within a first insulator to form a sub-assembly via a first stage insert-molding process, wherein the lower terminals including lower grounding terminals with corresponding front abutting sections and lower power terminals with corresponding front abutment sections;

disposing a plurality of upper terminals upon an upper surface of the sub-assembly and applying a second insulator upon the sub-assembly to form a complete contact module via a second stage insert-molding process;

during the second stage insert-molding process, corresponding mold dies press the front abutting sections and the front abutment sections to have the corresponding upper grounding terminals and lower grounding terminals abut against the shielding plate, and have the corresponding upper power terminal and lower power terminal abut against each other in a reliable manner; and forming corresponding upper holes and lower holes in opposite upper and lower surfaces of the final contact module due to removal of said mold dies to have said front abutment sections and said front abutment sections exposed to an exterior.

6. The method as claimed in claim 5, wherein said upper holes and said lower holes are filled with a third insulator to veil the front abutting sections and the front abutment sections.

* * * * *